US012104489B2

(12) United States Patent
Pandya et al.

(10) Patent No.: US 12,104,489 B2
(45) Date of Patent: Oct. 1, 2024

(54) WELL PATH DRILLING TRAJECTORY AND CONTROL FOR GEOSTEERING

(71) Applicant: Landmark Graphics Corporation, Houston, TX (US)

(72) Inventors: Raja Vikram Raj Pandya, Katy, TX (US); Srinath Madasu, Houston, TX (US); Keshava Prasad Rangarajan, Sugarland, TX (US); Shashi Dande, Spring, TX (US); Yashas Malur Saidutta, Atlanta, GA (US)

(73) Assignee: Landmark Graphics Corporation, Houston, TX (US)

( * ) Notice: Subject to any disclaimer, the term of this patent is extended or adjusted under 35 U.S.C. 154(b) by 226 days.

(21) Appl. No.: 17/619,784

(22) PCT Filed: Feb. 10, 2020

(86) PCT No.: PCT/US2020/017467
§ 371 (c)(1),
(2) Date: Dec. 16, 2021

(87) PCT Pub. No.: WO2021/040787
PCT Pub. Date: Mar. 4, 2021

(65) Prior Publication Data

US 2022/0316278 A1 Oct. 6, 2022

Related U.S. Application Data

(60) Provisional application No. 62/891,043, filed on Aug. 23, 2019.

(51) Int. Cl.
*E21B 7/04* (2006.01)
*E21B 44/02* (2006.01)

(52) U.S. Cl.
CPC ..... *E21B 7/04* (2013.01); *E21B 44/02* (2013.01)

(58) Field of Classification Search
CPC ..... E21B 7/04; E21B 47/022; E21B 44/00; E21B 47/0228; E21B 47/02
See application file for complete search history.

(56) References Cited

U.S. PATENT DOCUMENTS 9,097,096 B1 * 8/2015 Selman ..... E21B 47/022
9,322,261 B2 * 4/2016 Selman ..... E21B 44/00
(Continued)

FOREIGN PATENT DOCUMENTS

WO 2021010943 1/2021

OTHER PUBLICATIONS

Halliburton, "DecisionSpace Drilling and Completions", 2013, 4 pages.

(Continued)

*Primary Examiner* — Daniel P Stephenson
(74) *Attorney, Agent, or Firm* — Kilpatrick Townsend & Stockton LLP

(57) ABSTRACT

Geosteering can be used in a drilling operation to create a wellbore that is used to extract hydrocarbons from a defined zone within the subterranean formation. According to some aspects, generating paths for the wellbore may include using path-planning protocols and pure-pursuit protocols. The pure-pursuit protocol may be executed to output a plurality of candidate drilling paths. The output may also include control parameters for controlling the drill bit. A trajectory optimizer may determine a result of multi-objective functions for each candidate path. A cost function may represent a cost or loss associated with a candidate path. Additionally, the trajectory optimizer may perform an optimization protocol, such as Bayesian optimization, on the cost functions (Continued)

to determine which candidate path to select. The selected candidate path may correspond to new control parameters for controlling the drill bit to reach the target location.

20 Claims, 11 Drawing Sheets

(56) References Cited

U.S. PATENT DOCUMENTS

2008/0105424 A1* 5/2008 Remmert ..... E21B 45/00 175/50
2011/0137618 A1 6/2011 Fluharty, II et al.
2011/0161133 A1* 6/2011 Staveley ..... E21B 44/00 705/7.11
2012/0024605 A1 2/2012 Elinas et al.
2012/0285701 A1* 11/2012 Cheng ..... E21B 43/30 166/369
2013/0032402 A1* 2/2013 Byreddy ..... E21B 47/12 175/27
2013/0140037 A1* 6/2013 Sequeira, Jr. ..... E21B 7/04 703/10
2014/0020953 A1* 1/2014 Chau ..... E21B 47/12 175/48
2015/0275646 A1* 10/2015 Benson ..... E21B 44/00 700/275
2015/0330209 A1 11/2015 Panchal et al.
2018/0101915 A1 4/2018 Benson et al.
2019/0078427 A1 3/2019 Gillan
2019/0128114 A1* 5/2019 Bryant ..... E21B 47/107
2022/0316278 A1* 10/2022 Pandya ..... E21B 7/04

OTHER PUBLICATIONS

Halliburton, "iCruise Intelligent Rotary Steerable System", Feb. 2019, 1 page.
International Application No. PCT/US2020/017467, International Search Report and Written Opinion, mailed on Jun. 5, 2020, 12 pages.
Nasser, "Real Time Rate of Penetration, Prediction and Optimization During Drilling Operations", Jul. 2012, 88 pages.
Zheng, "Path Optimization Advisor and Analytical Tools for Directional Drilling", 2017, 99 pages.

* cited by examiner (a) Path Realization 1

(b) Path Realization 2

(c) Path Realization 3

(d) Optimal Paths

WELL PATH DRILLING TRAJECTORY AND CONTROL FOR GEOSTEERING

TECHNICAL FIELD

The present disclosure relates generally to wellbore drilling for hydrocarbon production in subterranean formations. More specifically, but not by way of limitation, this disclosure relates to geosteering for a wellbore drilling operation by executing path-planning and pure-pursuit protocols to determine drilling control parameters.

BACKGROUND

Drilling a wellbore involves controlling a drill bit to follow a predefined well path in a subterranean formation. The physical constraints of the drill bit and the uncertainty of conditions within the subterranean formation, however, often cause the drill bit to veer off course from the predefined well path. Precise techniques for tracking the drill bit along the predefined well path may be lacking. Additionally, if the drill bit veers off course, controlling the drill bit to reach a target location may cause increased wear on equipment.

DETAILED DESCRIPTION

Figure 1:
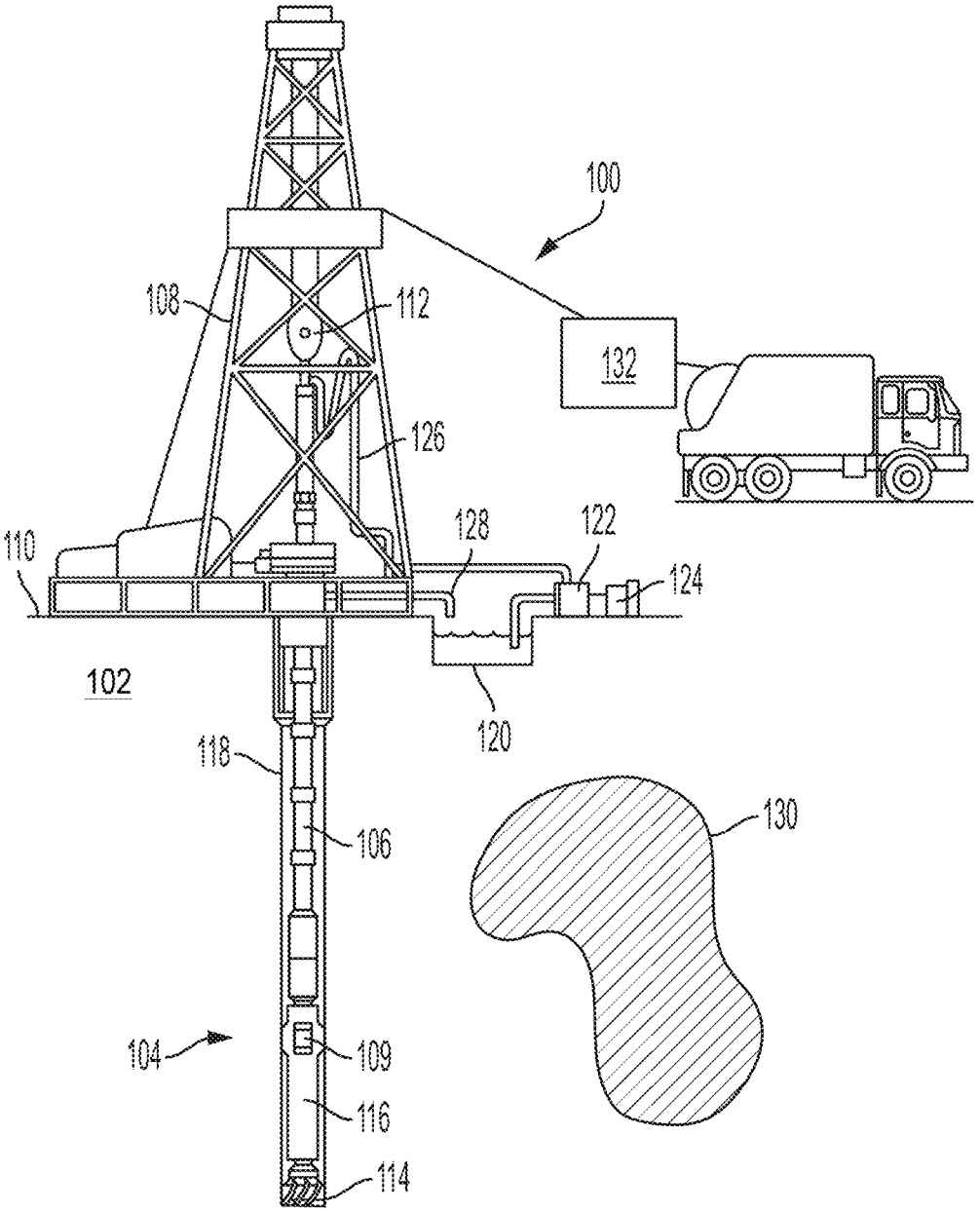
FIG. 1 is an example of a wellbore drilling operation using a drill bit to drill in a subterranean formation, according to some aspects.

Certain aspects and features of the present disclosure relate to geosteering of a drilling subsystem to guide a drilling operation using pure-pursuit protocols. Geosteering can involve adjusting a direction of the drilling subsystem in drilling a wellbore to reach a target location in a subterranean formation. Geosteering can be used in a drilling operation to create a wellbore that is used to extract hydrocarbons from a defined zone (e.g., a pay zone) within the subterranean formation. The pure-pursuit protocol may include code that, when executed, determines the curvature of a path designed to move the drill bit to a target location.

The pure-pursuit protocol may output one or more candidate drilling paths for the drill bit to follow to reach the target location. The output may also include control parameters for controlling movement of the drill bit.

In some implementations, a trajectory optimizer may determine a result of one or more cost functions for each candidate path. A cost function may represent a cost or loss associated with a candidate path to the target location. Further, the trajectory optimizer may perform an optimization protocol, such as Bayesian optimization, on the cost functions to determine which candidate path to select. For example, the Bayesian optimization may identify the candidate path associated with the lowest cost function as compared to the other cost functions. The selected candidate path may correspond to new control parameters for controlling the drill bit to follow a new drilling path to reach the target location.

Some examples can involve generating drilling trajectories and control parameters for controlling the drill bit under the physical constraints of the drill bit. For example, the physical constraints of the drill bit may include kinematics (e.g., dogleg severity) and dynamics (e.g., velocity) constraints. Certain aspects include utilizing geosteering information based on machine learning for drilling automation. Additionally, certain aspects may relate to generating multiple possible paths using the pure-pursuit protocol and selecting an optimum path based on a Bayesian optimization of the cost functions. In some examples, the cost functions may be comprised of multi-objectives during well path planning and real-time drilling under a single optimization framework.

A system according to some examples can improve the efficiency of predicting a well path and setting controllable parameters, such as rate of penetration (ROP) and weight of bit (WOB), for drilling operations. The controllable parameters and the well path can be generated and utilized for real-time, closed-loop control and automation of drilling along the well path.

A process flow for enhancing wellbore planning and tracking can be implemented in some examples. The process flow may comprise: (1) generating possible reference path(s) between start and end locations (in a three-dimensional (3D) or two-dimensional (2D) physical space) in the presence of obstacles by using any path planning algorithms, such as, rapidly exploring random tree (RRT), RRT*, robotic planning techniques, such as A* search, D* search, HD* search, and other suitable search algorithms; (2) generating a drilling path that satisfies kinematic, safety, and velocity constraints of a drill bit using any path-planning algorithms and the pure-pursuit algorithm, which results in well path, well trajectory and control parameters for controlling drill bit motion along the trajectory; (3) selecting a well path, which satisfies objective functions, from possible paths generated by performing a Bayesian optimization or any other suitable optimization algorithm; (4) characterizing each possible path using an overall cost function to represent the cost or loss associated with the path; and (5) coupling geosteering information relating to subsurface obstacles and drilling parameter optimization with the trajectory optimization under the Bayesian optimization framework.

Using some examples of the present disclosure, a reference well path between start and end locations can be generated based in part on a presence or absence of obstacles. The reference well path may be used for path planning purposes. Further, the system may generate a drilling path using a pure-pursuit algorithm, physical constraints of the drill bit (e.g., kinematic constraints or dynamic constraints), and the reference well path. The system can generate possible well paths from a drill location to a target location by executing the pure-pursuit protocol. The system can generate a drilling path based on a selected objective function and control a drill bit to move along the drilling path.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view of an example of a well system 100, according to some aspects. A wellbore may be created by drilling into the subterranean formation 102 using the drilling system 100. The drilling system 100 may be configured to drive a bottom hole assembly (BHA) 104 positioned or otherwise arranged at the bottom of a drill string 106 extended into the subterranean formation 102 from a derrick 108 arranged at the surface 110. The derrick 108 includes a kelly 112 used to lower and raise the drill string 106. The BHA 104 may include a drill bit 114 operatively coupled to a drill string 116, which may be moved axially within a drilled wellbore 118 as attached to the drill string 106. Drill string 116 may include one or more sensors 109 to determine a location of the drill bit and wellbore or conditions of the subterranean formation. The one or more sensors 109 may return sensor data for various parameters to the surface through cabling (not shown) or by wireless signal. The combination of any support structure (in this example, derrick 108), any motors, electrical connections, and support for the drill string and tool string may be referred to herein as a drilling arrangement.

During operation, the drill bit 114 penetrates the subterranean formation 102 and thereby creates the wellbore 118. The BHA 104 provides control of the drill bit 114 as it advances into the subterranean formation 102. Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles (not shown) arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that cleaned mud is returned down hole through the stand pipe 126 once again.

The drilling arrangement and any sensors 109 (through the drilling arrangement or directly) are connected to a computing device 132. The computing device 132 can be positioned at the well surface 110 or elsewhere (e.g., offsite). The computing device 132 may be in communication with the drill string 116, the sensor 109, or another electronic device. For example, the computing device 132 can have a communication interface for transmitting information to and receiving information from another communication interface of the tool string.

In some examples, the computing device 132 can receive information from downhole (or elsewhere) in substantially real time, which can be referred to as real-time data. The real time data can include information related to the well system 100. For example, the drill string 116 can stream real-time data to the computing device 132, where the real-time data may include information about the orientation or location of the drill bit 114 in the wellbore 118, or a rate of movement of the drill bit 114 through the wellbore 118. The computing device 132 can use the real-time data to provide an ROP of the drill bit 114 through the subterranean formation 102 and to provide a location of the drill bit relative to a drill path, waypoints, and obstacles, such as obstacle 130. Computing device 132 can generate drilling paths for wellbore 118 and generating commands for controlling drill bit 114 by executing the pure-pursuit protocol, according to some aspects.

Figure 2:
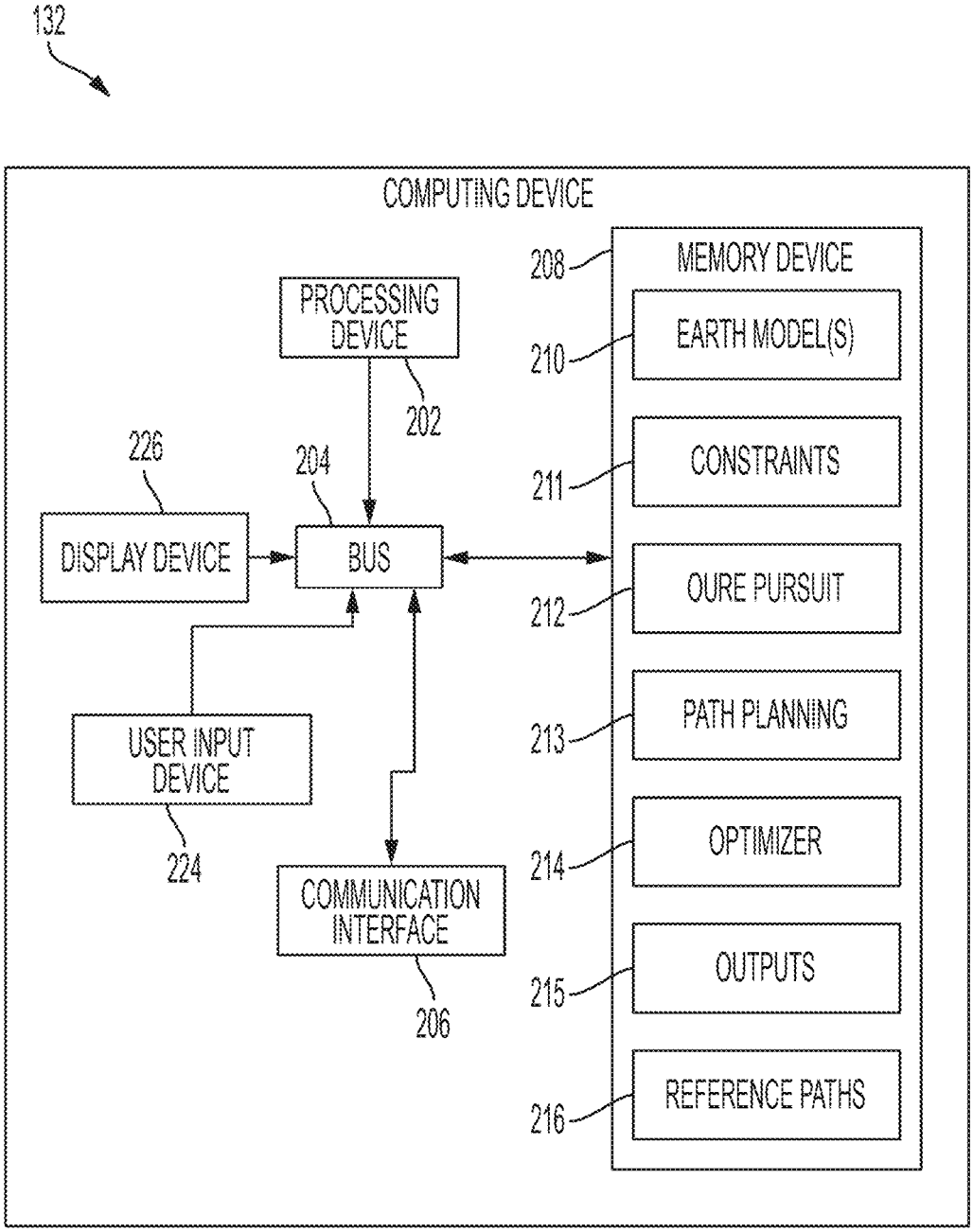
FIG. 2 is a block diagram illustrating a computing device for generating drilling paths, according to some aspects.

FIG. 2 depicts an example of the computing device 132, according to some aspects. The computing device 132 can include a processing device 202, a bus 204, a communication interface 206, a non-transitory or non-volatile memory device 208, a user input device 224, and a display device 226. In some examples, some or all of the components shown in FIG. 2 can be integrated into a single structure, such as a single housing. In other examples, some or all of the components shown in FIG. 2 can be distributed (e.g., in separate housings or in separate locations) and in wired or wireless communication with each other.

The processing device 202 (e.g., a Field-Programmable Gate Array ("FPGA"), an application-specific integrated circuit ("ASIC"), a microprocessing device, Graphics Processing Unit (GPU), Vector Processor, etc.) can be communicatively coupled to the memory device 208 via the bus 204. The non-volatile memory device 208 may include any type of memory device that retains stored information when powered off. Non-limiting examples of the memory device 208 include electrically erasable and programmable read-only memory ("EEPROM"), flash memory, or any other type of non-volatile memory. In some examples, at least some of the memory device 208 can include a non-transitory medium from which the processing device 202 can read instructions. A non-transitory machine-readable storage medium can include electronic, optical, magnetic, or other storage devices capable of providing the processing device 202 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

In some examples, the memory device 208 can store earth model 210, such as the locations of waypoints, starting and ending locations, subsurface conditions, and obstacles within a subterranean formation. The memory device 208 can also store constraints 211. The constraints may include the kinematics constraints (e.g., dogleg severity), safety constraints, or velocity constraints (e.g., force, torque, or drag constraints that maximize ROP of a drill bit) related to the drill string and drill bit of a drilling subsystem. In some examples, the memory device 208 can store executable computer program instructions in pure pursuit 212 for executing a pure-pursuit protocol to generate new drilling paths with updated control parameters. The memory device 208 can store executable computer program code instructions in path planning 213 for executing a path-planning protocol, which makes use of stored reference paths 216.

The memory device 208 can store executable computer program instructions optimizer 214 for performing optimization calculations for the drill path. Results from executing the pure pursuit 212, path planning 213, or optimizer 214 can be stored as output values 215 in the memory device 208.

In some examples, the computing device 132 includes a communication interface 206. The communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or other mobile communications network).

In some examples, the computing device 132 includes a user input device 224. The user input device 224 can represent one or more components used to input data. Examples of the user input device 224 can include a keyboard, mouse, touchpad, button, or touch-screen display, etc.

In some examples, the computing device 132 includes a display device 226, which can render and display a visual realization of the planned well paths or the drilling operation in real time and other information used in the process described herein. The display device 226 can represent one or more components used to output data. Examples of the display device 226 can include a liquid-crystal display (LCD), a television, a computer monitor, a touch-screen display, etc. In some examples, the user input device 224 and the display device 226 can be a single device, such as a touch-screen display.

Figure 3:
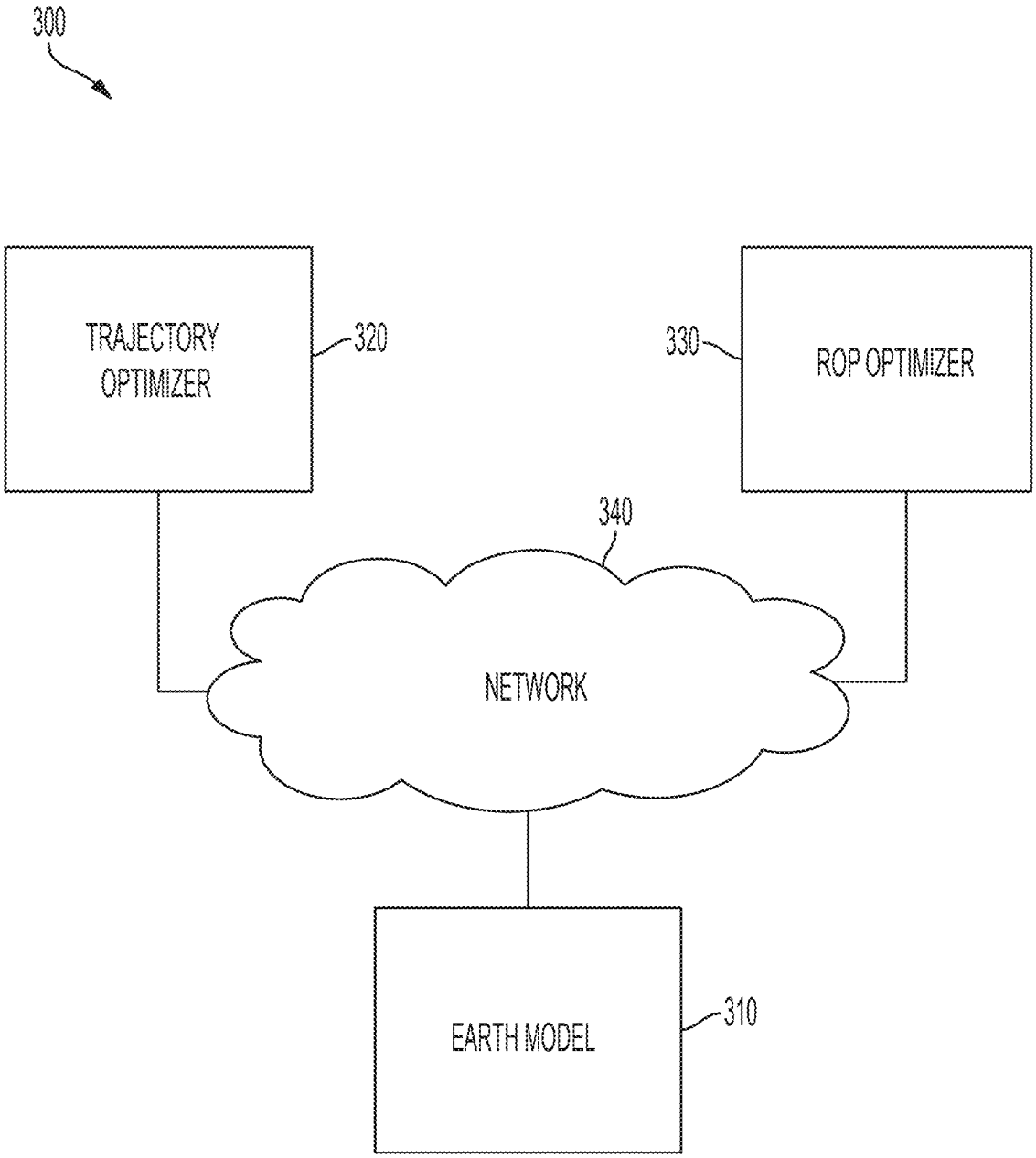
FIG. 3 is a block diagram illustrating an example of a network environment configured to control operation of a drill bit, according to some aspects.

FIG. 3 is a block diagram illustrating an example of a network environment 300 configured to control operation of the drilling system 100, according to some aspects. In some implementations, network environment 300 may include earth model 310, trajectory optimizer 320, and ROP optimizer 330 connected over network 340. Network environment 300 may enable computing device 132 or the various distributed components of computing device 132 to generate commands that control the drill bit 114 of drilling system 100 to follow certain drilling paths.

Earth model 310 may be generated using well logs to represent the subsurface information of a subterranean formation. A well log may be a detailed record of geological properties or formations detected by a borehole penetrating the subterranean formation. Earth model 310 may indicate the presence or absence of obstacles, such as salt bodies, faults, areas with high mud loss or porosity levels. The earth model 310 may indicate subsurface properties that may represent obstacles to the trajectory optimizer 320. Illustrative examples of subsurface properties include permeability, porosity, facies, faults, pore pressure, well locations, and other suitable subsurface properties. The permeability and porosity may be determined using well logs and neural networks in a well pad. The permeability and porosity properties may be used to predict subsurface salt bodies (e.g., where the permeability and porosity is low).

Trajectory optimizer 320 may be a processor configured to execute instructions stored in a computer memory. Executing the instructions may cause the trajectory optimizer 320 to generate drilling paths for the drill bit 114 using the pure-pursuit protocol and an optimization protocol. As an illustrative example, trajectory optimizer 320 may receive as input (1) a start location (e.g., the location of the drill bit 114), (2) a target location, (3) one or more waypoints through which the well path must pass, and (4) the location of obstacles, as indicated by the earth model 310. Trajectory optimizer 320 may execute the pure-pursuit protocol to evaluate the inputs and generate a drill path that avoids the obstacles and passes through any waypoints.

The ROP optimizer 330 may be a processor configured to execute instructions stored in a computer memory. Executing the instructions may cause the ROP optimizer 330 to generate control parameters for controlling the rate of penetration of the drill bit 114 and other controllable aspects of the drill bit 114. The ROP optimizer 330 may evaluate the earth model 310 to detect subsurface properties of the subterranean formation along the well path generated by the trajectory optimizer 320. ROP optimizer 330 may adjust the controllable parameters of the drill bit 114 based on the detected subsurface parameters.

Figure 4:
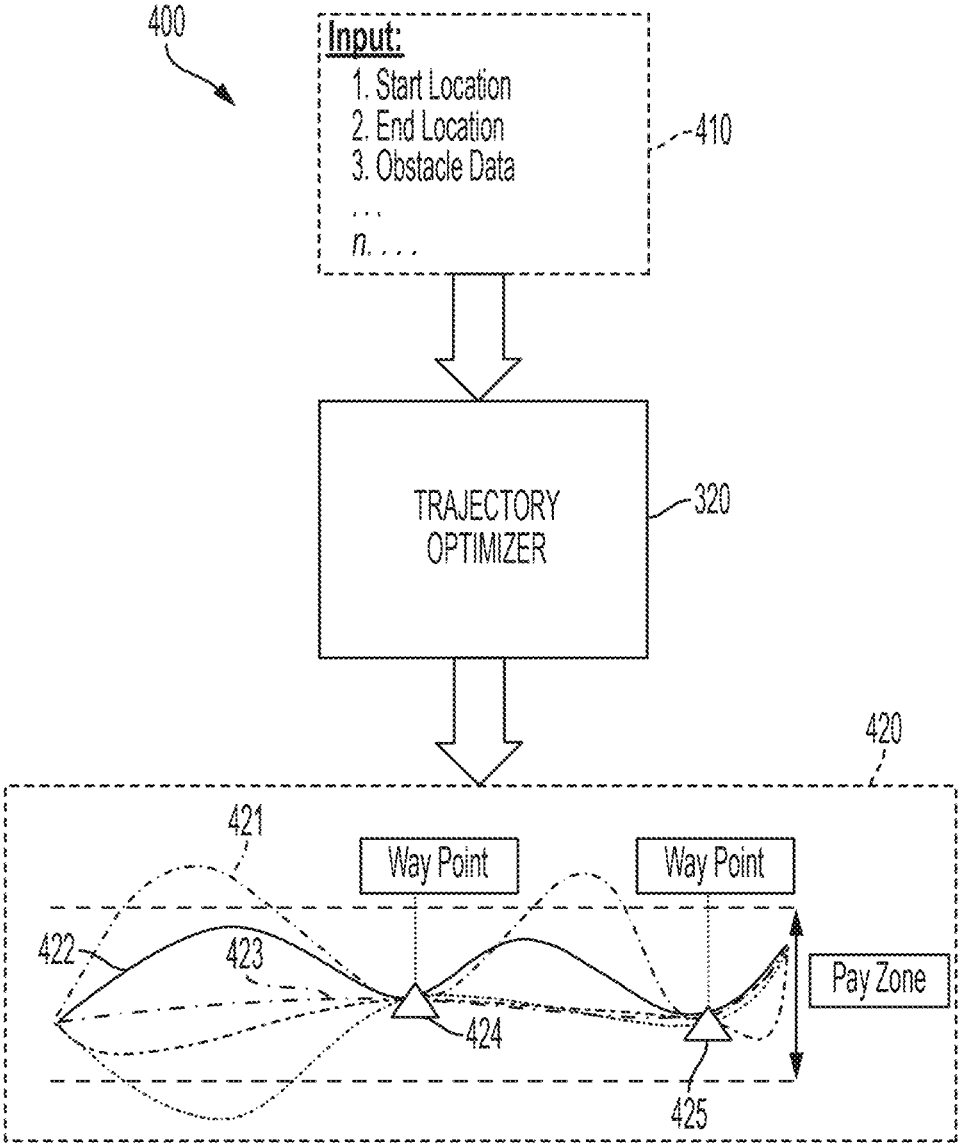
FIG. 4 is a flow diagram illustrating a process for planning a well path for hydrocarbon production, according to some aspects.

FIG. 4 is a flow diagram illustrating a process 400 for planning a well path for hydrocarbon production, according to some aspects. Process 400 may be performed before a drilling operation begins. For example, process 400 may generate control parameters for controlling the drill bit 114 to follow a well path. Illustrative examples of control parameters may include bit trajectory, azimuth, direction, inclination, and other suitable controllable parameters.

Process 400 may begin at step 410, where the start location, the end location, and the obstacle data may be inputted into the trajectory optimizer 320. The obstacle data may represent the presence or absence of obstacles, as indicated by the earth model 310. The trajectory optimizer 320, as shown in FIG. 4, may also include the ROP optimizer 330. Any number of other data points may be inputted into the trajectory optimizer 320, such as the location of one or more waypoints.

The trajectory optimizer 320 may execute a path-planning protocol using the start location, the end location, and the obstacle data. The path-planning protocol may include executing any path-planning algorithm, such as rapidly exploring random tree (RRT), RRT*, robotic planning techniques (e.g., A* search, D* search, HD* search), and other suitable search algorithms. Due to the uncertainty of the subsurface conditions represented by earth model 310, executing the path-planning protocol may result in multiple candidate well paths, as shown in step 420. Step 420 represents an example of the output of the trajectory optimizer 320. For example, trajectory optimizer 320 may generate candidate well paths 421, 422, and 423. Each of candidate well paths 421, 422, and 423 may pass through waypoints 434 and 435.

In some implementations, trajectory optimizer 320 may rank the candidate well paths 421, 422, and 423 using one or more objective functions. As illustrative examples, objective functions may include the following:

1. Geometry related:

$$O_g = A_1 \int_{l_0}^{l_T} \frac{\kappa^2}{L} ds + A_2 \int_{l_0}^{l_T} \frac{\tau^2}{L} ds + A_3 \frac{s}{L} \quad \text{(Equation 1)}$$

Here L is distance between drill bit and target locations; $\kappa$, $\tau$ represent curvature and torsion along the well path, respectively; $l_T$, $l_0$ represent target and drill bit locations; ROP represents a predicted optimum rate of penetration along the well path; $ROP_{max}$ represents a maximum possible ROP for normalization purposes; S represents a well path length; h and $h_s$ represent initial and final characteristic heights of drill bit cutting elements, respectively; and $A_1$, $A_2$, $A_3$, $B_1$, $C_1$ are constants.

2.

$$\text{Tortuosity Index } O_{tort} = \frac{n-1}{n * L_C} \sum_{i=1}^{n} \frac{L_{csi}}{L_{xsi}} - 1, \quad \text{(Equation 2)}$$

where n represents the number of path intervals, Lc represents the total path distance, Lcsi represents the path in interval i, Lxsi represents the shortest possible path between start point and end point.

3. Productivity missed due to pay zone.

$$\text{Productivity loss Index } O_{prod} = \frac{\text{Profit}}{\text{Lateral}} * Payzonemissed \quad \text{(Equation 3)}$$

4. Bit wear related:

$$O_{wear} \frac{dh}{dt} = \frac{1}{\tau_H} \left(\frac{N}{60}\right)^{H_1} \left[\frac{\left(\left(\frac{WOB}{d_b}\right)_{max} - 4\right)}{\left(\frac{WOB}{d_b}\right)_{max} - \left(\frac{WOB}{d_b}\right)}\right] \left(\frac{1 + \frac{H_2}{2}}{1 + H_2 h}\right) \quad \text{(Equation 4)}$$

$$J_2 = \left[\frac{\left(\left(\frac{WOB}{d_b}\right)_{max} - 4\right)}{\left(\frac{WOB}{d_b}\right)_{max} - \left(\frac{WOB}{d_b}\right)}\right] \left(\frac{60}{N}\right)^{H_1} \left(\frac{1}{1 + \frac{H_2}{2}}\right)$$

$$\tau_H = \frac{t_b}{J_2\left(h_f + H_2 \frac{h_f^2}{2}\right)}$$

$$t_b = J_2 \tau_H \left(h_f + H_2 \frac{h_f^2}{2}\right)$$

H1, H2 and (WOB/db)max represent inputs for the bit class. $d_b$ represents the drill bit diameter.

5. Overall cost of drilling and safety related:

$$O_{cost,safety} \quad \text{(Equation 5)}$$

6. Drilling time related:

$$O_{ROP} = \text{Max ROP} \quad \text{(Equation 6)}$$

7.

$$\text{Mechanical Specific Energy } (MSE) \text{ (Teale Model)} O_{MSE} \quad \text{(Equation 7)}$$

$$MSE = \frac{WOB}{\text{Area}} + \frac{2\pi * RPM * \text{Torque}}{\text{Area} * ROP}$$

Area represents the cross-sectional area of the drill bit.

The overall cost function is the sum of the objectives below:

$$\text{Cost of a well path} = O_g + I_{tort} + O_{prod} + O_{wear} + O_{cost,safety} \quad \text{(Equation 8)}$$

Equation 8 can be optimized along with the ROP and mechanical specific energy (MSE). ROP and MSE may be a function of WOB, RPM, inclination, azimuth (from the path), and sub-surface properties.

The trajectory optimizer 320 may perform an optimization protocol, such as a Bayesian optimization, on the multi-objective functions (e.g., Equations 1 through 7 above) to select a candidate well path that is associated with the lowest cost (as determined in Equation 8). The candidate well path associated with the lowest cost, as compared to the other remaining candidate well paths, may represent the target or optimal well path for the drill bit 114 to follow. The selected candidate well path may correspond to control parameters (e.g., ROP, azimuth, inclination) for controlling the drill bit 114 to follow the selected candidate well path.

Figure 5:
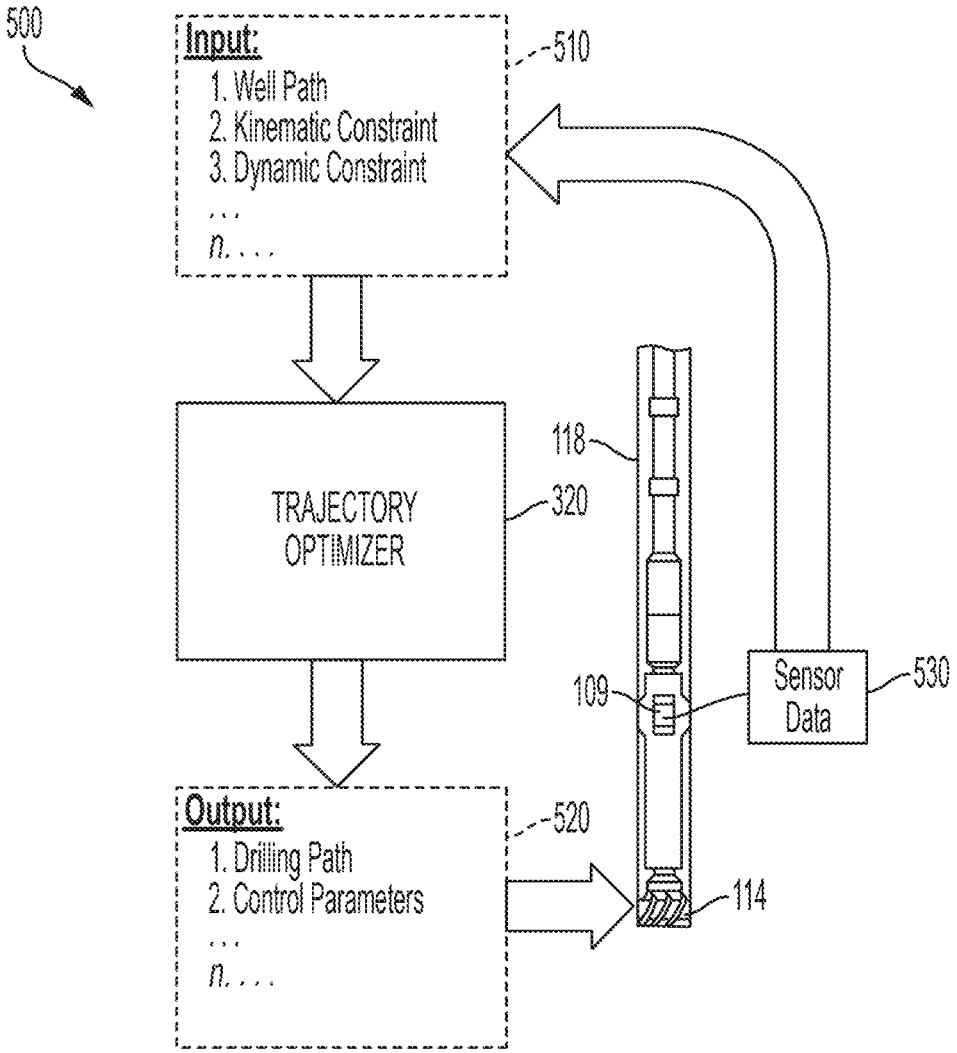
FIG. 5 is a flow diagram illustrating an example of a process for dynamically controlling a drill bit according to a pure-pursuit protocol, according to some aspects.

FIG. 5 is a flow diagram illustrating a process for dynamically controlling a drill bit during drilling operation, according to some aspects. Process 500 may be performed during a drilling operation while the drill bit 114 is drilling in the subterranean formation along the well path selected in FIG. 4. Process 500 may generate a new well path from a location of the drill bit 114 to the target location. For example, trajectory optimizer 320 may generate a new well path during the drilling operation if the drill bit 114 has veered off course from the well path selected in FIG. 4. The new well path may correspond to new control parameters for the drill bit 114 to follow the new well path.

Process 500 may begin at step 510, where the well path and one or more physical constraints of the drill bit 114 may be inputted into the trajectory optimizer 320. For example, the physical constraints of the drill bit 114 may include a kinematic constrain, such as a dogleg severity, and a dynamics constraint, such as a constraint governing the velocity of the drill bit 114. The trajectory optimizer 320, as shown in FIG. 5, may also include the ROP optimizer 330. Any number of data points may be inputted into the trajectory optimizer 320.

Trajectory optimizer 320 may receive the input of the well path and the one or more physical constraints of the drill bit. Trajectory optimizer 320 may execute the pure-pursuit protocol using the inputted information. As an illustrative example, the pure-pursuit algorithm may include the following steps: (1) determine a current location of the drill bit 114 in a global coordinate system, (2) identify the closest point on the well path to the drill bit 114, (3) select a constant look-ahead distance, (4) identify coordinates on the well path that is the look-ahead distance away from the current location of the drill bit 114, (5) determine the curvature and steering angle for the drill bit 114 to reach the coordinates on the well path, and (6) generate commands to control the drill bit 114 to reach the coordinates on the well path. The trajectory optimizer 320 may generate output 520 including a new drilling path and the corresponding control parameters for controlling the drill bit 114 to follow the new drilling path. Similar to the description of FIG. 4, the trajectory optimizer 320 may generate multiple candidate well paths due to the uncertainty of the subsurface conditions. The trajectory optimizer 320 may evaluate the multiple candidate well paths using Equations (1) through (8) and perform an optimization, such as a Bayesian optimization, to select the candidate well path associated with the minimum or lowest cost (e.g., the result of Equation (8)).

In some implementations, trajectory optimizer 320 may perform the pure-pursuit protocol even if the drill bit 114 has not veered off course from the well path. For example, during the drilling operation, the one or more sensors 109 of the drill bit 114 may generate sensor data 530. The sensor data 530 may include the subsurface conditions of the subterranean formation that are not represented in the earth model 310. The earth model 310 may be updated by the sensor data 530 due to the natural uncertainty of subsurface information. If the sensor data 530, which is collected during the drilling operation, indicates that the well path may penetrate an unexpected obstacle, the trajectory optimizer 320 may execute the path-planning protocol and the pure-pursuit protocol to generate a new well path that avoids the unexpected obstacle.

Figure 6:
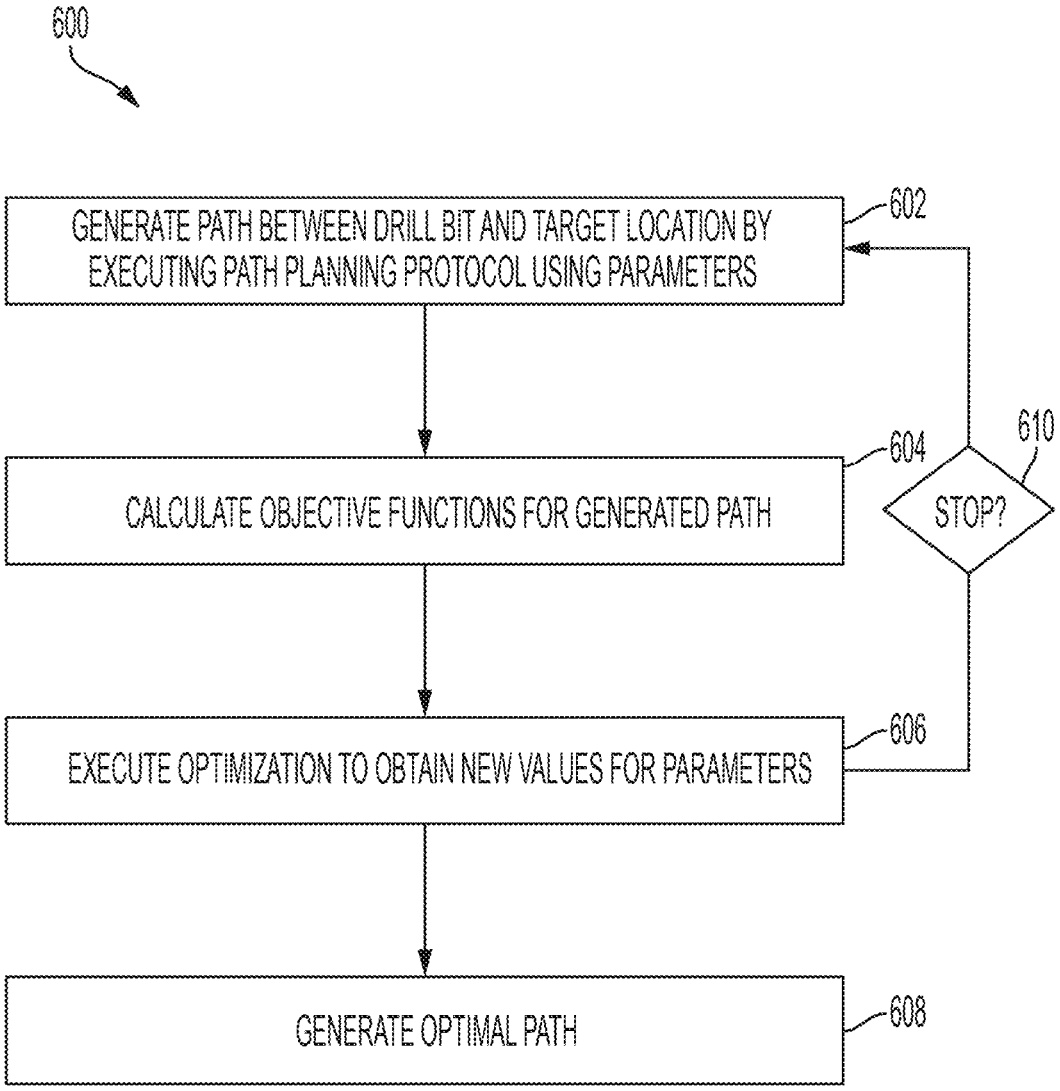
FIG. 6 is a flowchart illustrating an example of a process for planning a well path, according to some aspects.

FIG. 6 is a flowchart illustrating an example of a process 600 for planning a wellbore path, according to some aspects. Process 600 may be performed by computing device 132, the trajectory optimizer 320, or the ROP optimizer 330. Further, process 600 may be performed to generate a well path for a drilling operation.

Process 600 may begin with block 602, where, for example, computing device 132 may generate a well path between the drill bit and a target location by executing the path-planning protocol. The computing device 132 may input the start location (e.g., the location of the drill bit 114), the target location, the location of one or more waypoints, and any obstacles indicated by the earth model 310 into the path-planning protocol. The computing device 132 may generate one or more well paths as an output of executing the path-planning protocol.

At block 604, the computing device 132 may determine a result of one or more objective functions for each well path generated at block 602. Each of Equations (1) through (7) may be an objective function. Each objective function may represent an aspect of a well path. For example, Equation (2) may represent a cost associated with the tortuosity (e.g., a property of a curve being twisted) of a candidate well path. At block 606, computing device 132 may execute an optimization protocol, such as a Bayesian optimization, to obtain the values that yield the lowest result of the cost function (Equation 8). Examples of the optimization protocol include deterministic optimization algorithms and stochastic algorithms. In implementations where a single well path is generated at block 602, the optimization protocol may evaluate Equations (1) through (7) for the path to identify the variables that yield the lowest cost (from Equation 8). The identified variables may be used to design the well path and the control parameters for the drill bit 114. In implementations where multiple well paths are generated at block 602, the optimization protocol may evaluate Equations (1) through (7) to identify the candidate path with the lowest cost. At block 608, the candidate path associated with the lowest cost may be determined to be optimal amongst the remaining candidate paths. At decision block 610, computing device 132 may iteratively perform blocks 602 through 606 at regular or irregular time intervals. A termination condition may be set for stopping the iterations. For example, the termination condition may be satisfied after n iterations.

Figure 7:
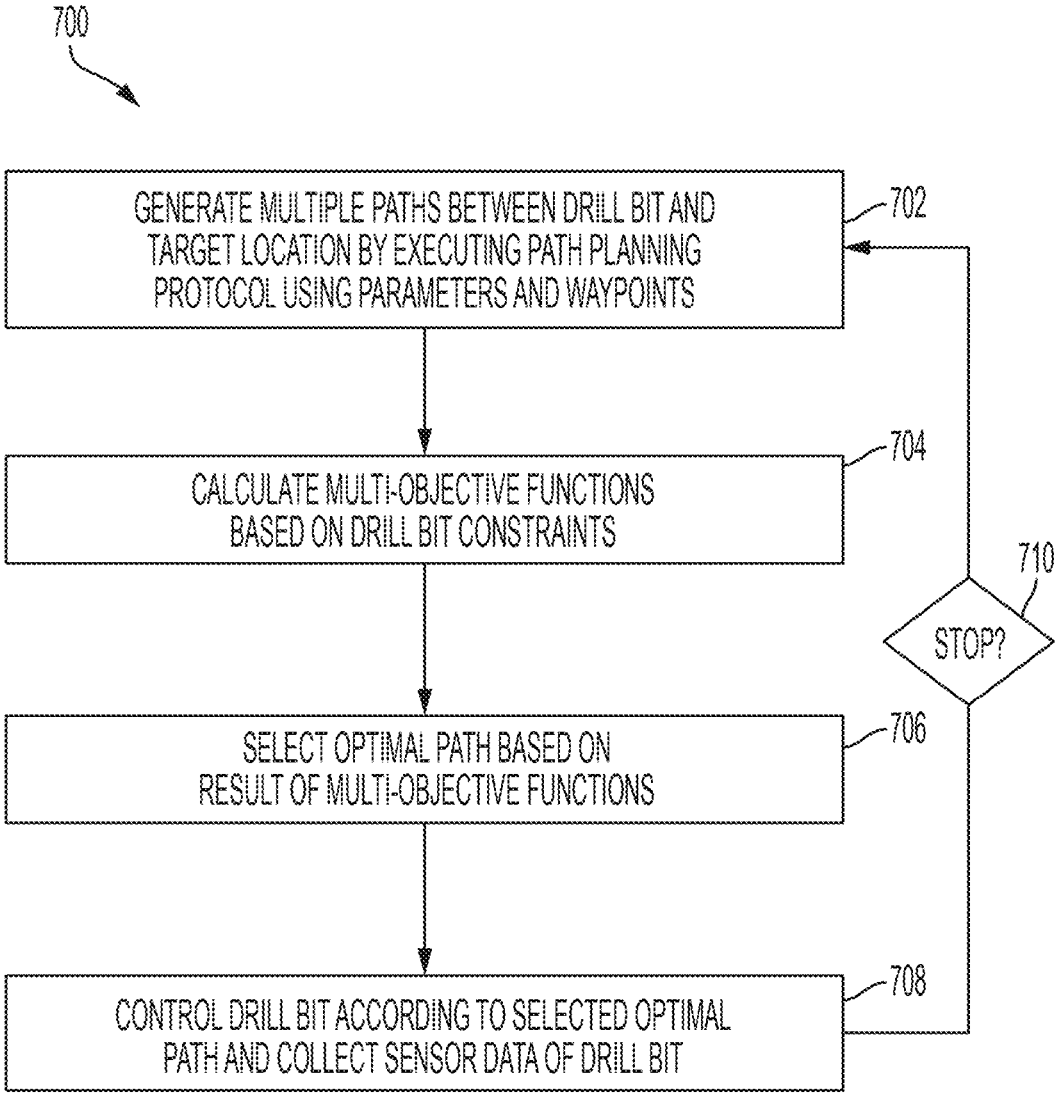
FIG. 7 is a flowchart illustrating an example of a process for generating a new well path while the drill bit is operating, according to some aspects.

FIG. 7 is a flowchart illustrating an example of a process 700 for generating a new wellbore path while the drill bit is operating, according to some aspects. Process 700 may be performed by computing device 132, the trajectory optimizer 320, or the ROP optimizer 330. Further, process 700 may be performed to generate a new well path during a drilling operation.

Process 700 may begin with block 702, where, for example, the computing device 132 may generate multiple paths between the location of the drill bit 114 and the target location by executing the path-planning protocol. Any waypoints may also be included. At block 704, the computing device 132 may determine a result for multi-objective functions based on the physical constraints of the drill bit 114. For example, the computing device 132 may determine the results of Equations (1) through (8) for each well path of the multiple well paths generated at block 702. The variables of a well path (e.g., the length of the path, the tortuosity of the path, and so on) may be used to determine the results of Equations (1) through (8).

At block 706, the computing device 132 may evaluate the results of the mufti-objective functions to select a well path associated with the lowest cost (e.g., the result of Equation 8). As an illustrative example, the computing device 132 may perform a Bayesian optimization on the results of the multi-objective functions to identify which well path is associated with the lowest cost. The selected well path may correspond to control parameters for controlling the drill bit 114 to follow the selected well path during the drilling operation.

At block 708, the computing device 132 may generate commands that control the drill bit 114 to follow the selected well path. Additionally, during the drilling operation, the one or more sensors 109 of the drill bit 114 may collect sensor data of subsurface conditions of the subterranean formation. The collected sensor data may be transmitted back to the computing device 132 to update the earth model 310 and potentially update the selected well path. At decision block 710, computing device 132 may iteratively perform blocks 702 through 708 at regular or irregular time intervals. A termination condition may be set for stopping the iterations. For example, the termination condition may be satisfied after n iterations.

Figure 8:
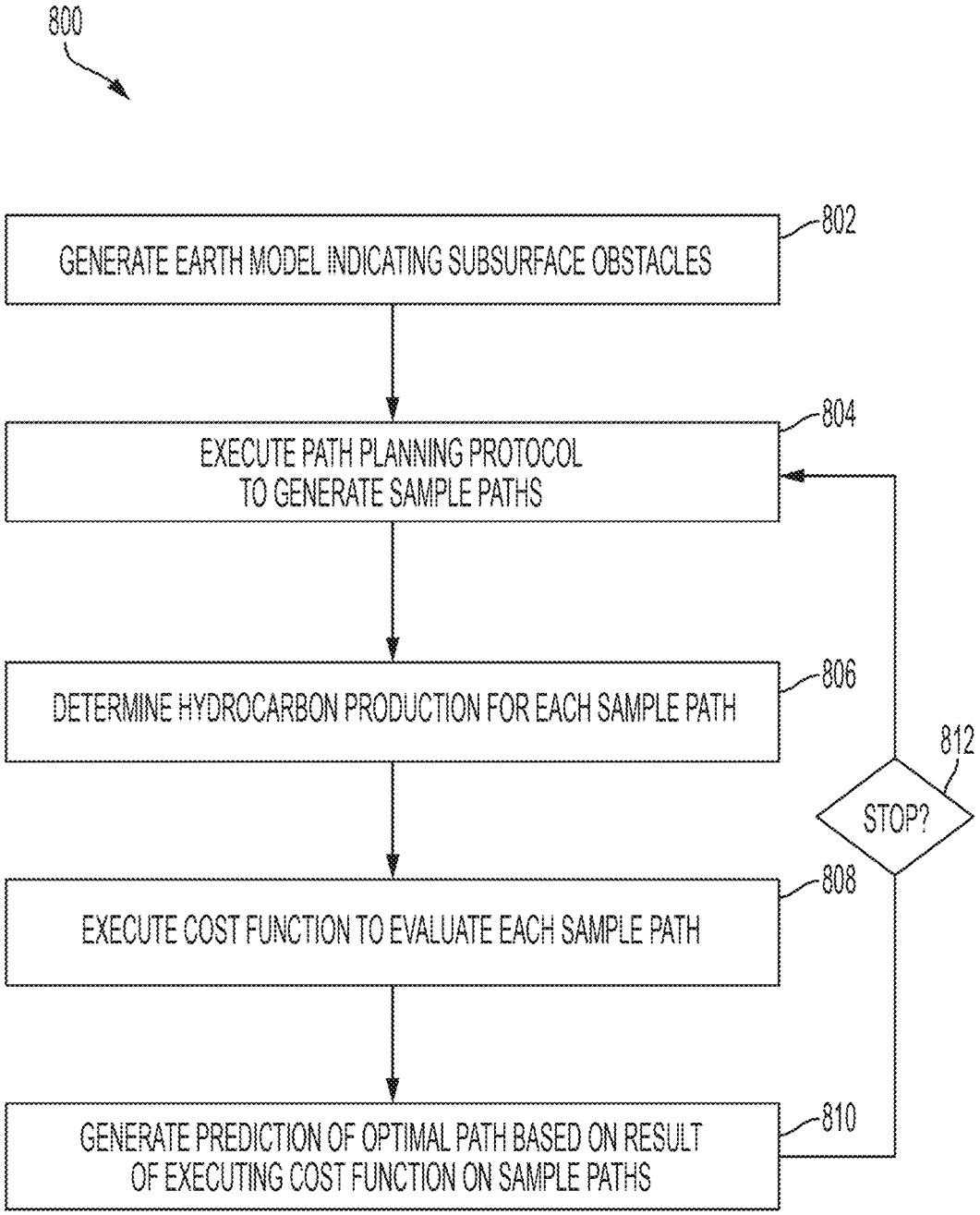
FIG. 8 is a flowchart illustrating an example of a process for iteratively evaluating multiple candidate paths for reaching a target location, according to some aspects.

FIG. 8 is a flowchart illustrating an example of a process for evaluating multiple candidate paths, according to some aspects. Process 800 may be performed by computing device 132, earth model 310, the trajectory optimizer 320, or the ROP optimizer 330. Further, process 800 may be performed to evaluate the results of multi-objective functions to select a well path from multiple well paths.

Process 800 may begin with block 802, where, for example, the computing device 132 may generate the earth model 310 from well logs characterizing a subterranean formation. The earth model 310 may indicate the presence or absence of subsurface obstacles. At block 804, the computing device 132 may execute a path-planning protocol and a pure-pursuit protocol to generate sample paths. At block 806, the computing device 132 may determine the hydrocarbon production for each sample path. The hydrocarbon production may be determined using the earth model and a machine-learning model (e.g., a neural network) to generate predictions of the hydrocarbon production along each sample path.

At block 808, the computing device 132 may determine the results of Equations (1) through (8) for each sample path generated at block 804. At block 810, the computing device 132 may generate a prediction of an optimal path from amongst the sample paths based on the results of the cost functions determined at block 808. As an illustrative example, the computing device may perform a Bayesian optimization on the multi-objective functions and cost functions generated at block 808. At decision block 812, computing device 132 may iteratively perform blocks 804 through 810 at regular or irregular time intervals. A termination condition may be set for stopping the iterations. For example, the termination condition may be satisfied after n iterations.

Figure 9:
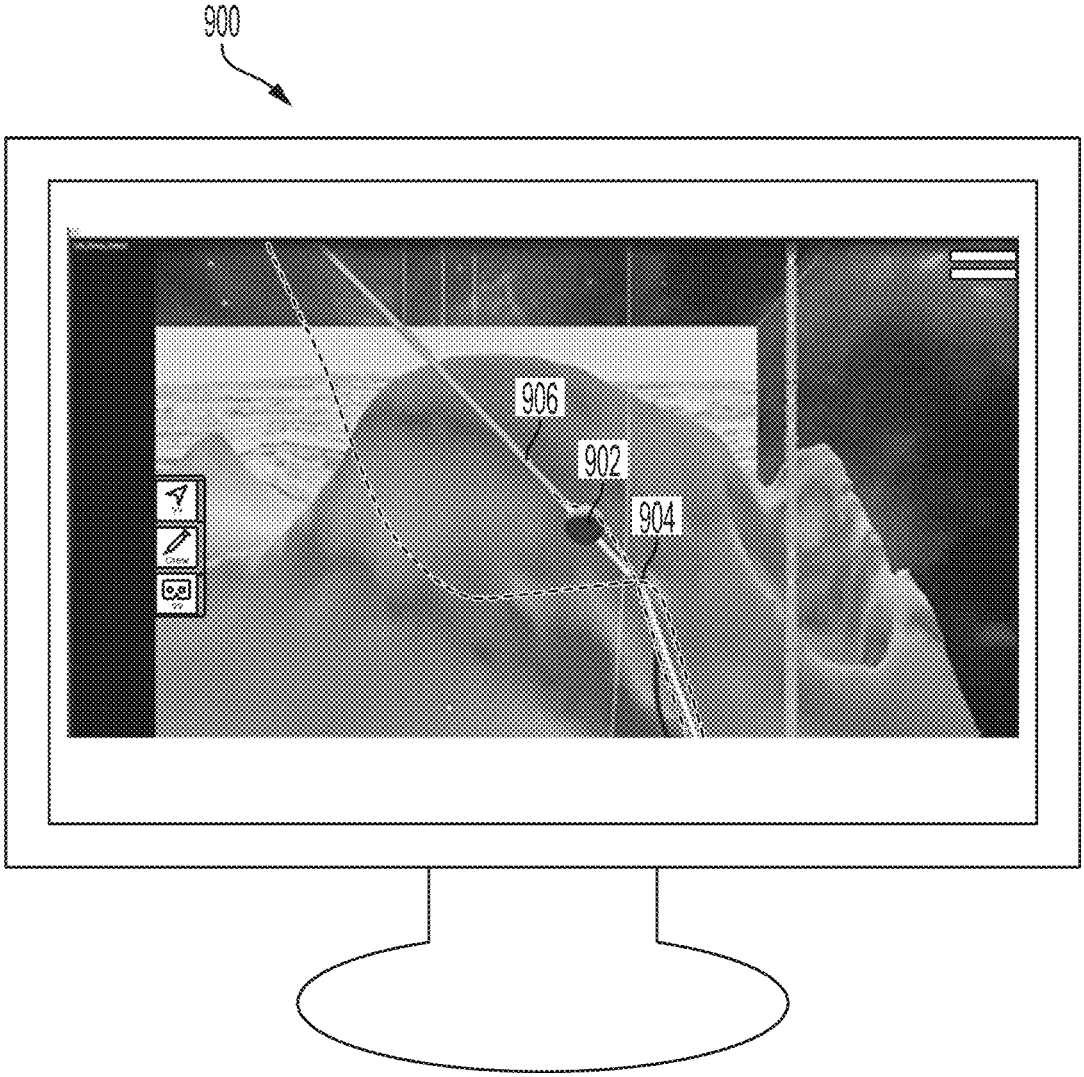
FIG. 9 is an interface displaying an example of an output of a computing device, according to some aspects.

FIG. 9 is an example of an interface 900 displaying an output, according to some aspects. The interface 900 may display a visual representation of the subterranean formation that is continuously updated as the drilling operation proceeds. The interface 900 may be displayed on the computing device 132. As an illustrative example, the visual indicator 902 for the drill bit may represent the location of the drill bit 114 in the subterranean formation. The visual indicator 906 for the well path may pass through the visual indicator 904 for the waypoint.

Figure 10:
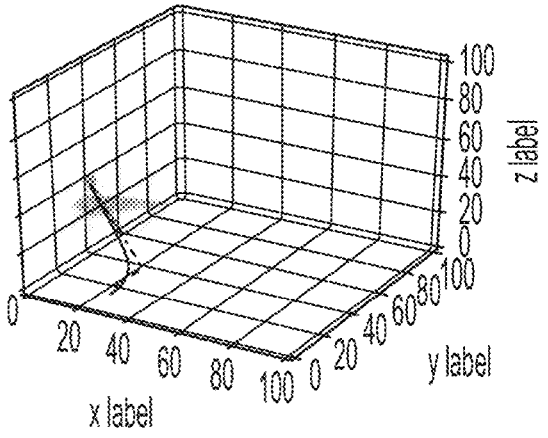
FIGS. 10-13 illustrate examples of well path realizations, according to some aspects.
Figure 11:
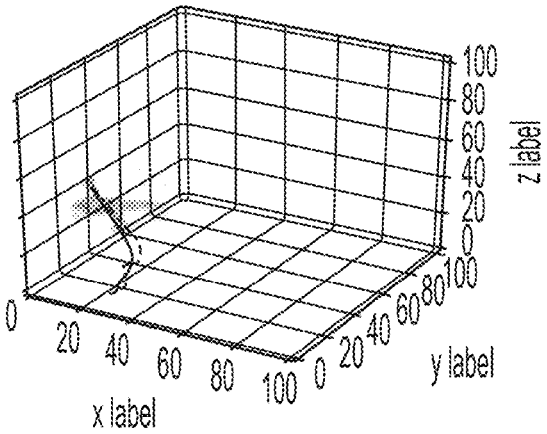
Figure 12:
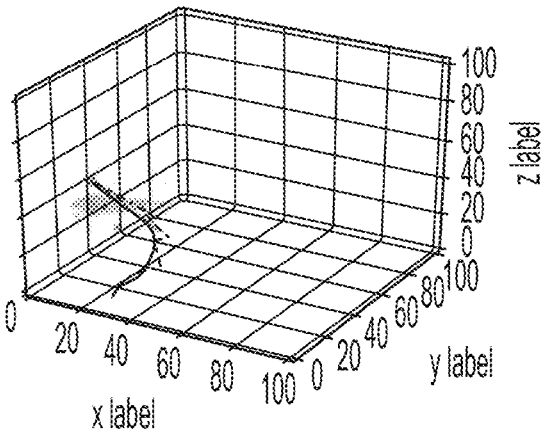
Figure 13:
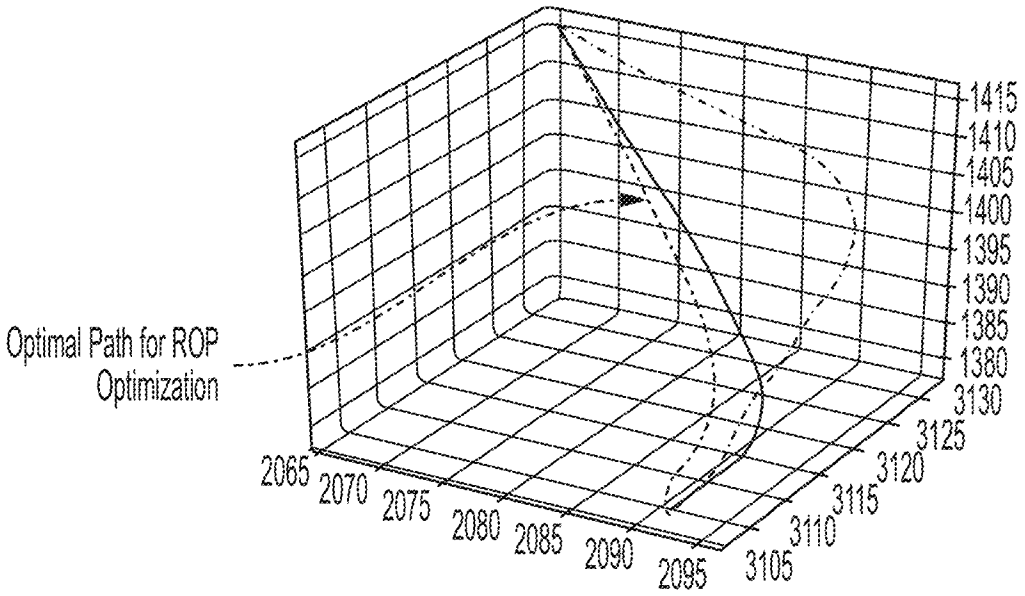

FIGS. 10-13 illustrate examples of well path realizations in a 3D environment, according to some aspects. FIGS. 10-12 illustrate the different path realizations generated by the path-planning protocol. FIG. 13 illustrates a target ROP for the path.

In some aspects, drilling paths and control parameters of a drilling operation can be generated according to one or more of the following examples. As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a non-transitory medium comprising instructions that are executable by the processing device to cause the processing device to perform operations comprising: generating, based on a presence or absence of obstacles within a subterranean formation, a reference well path for a drill bit adapted to drill in the subterranean formation, the reference well path including a start location and a target location; generating a drilling path for the drill bit using the reference well path and a physical constraint of the drill bit, the drilling path corresponding to a control parameter for controlling the drill bit, and the control parameter satisfying the physical constraint of the drill bit; tracking a location of the drill bit while the drill bit is drilling along the drilling path in the subterranean formation; generating, by executing a pure-pursuit protocol, a plurality of candidate well paths from the location of the drill bit to the target location; determining a result of an objective function for each candidate well path of the plurality of candidate well paths; selecting, based on the result of the objective function, a candidate well path from the plurality of candidate well paths, the selected candidate well path representing a target path from the location of the drill bit to the target location, and the selected candidate well path corresponding to a new control parameter for controlling the drill bit; and outputting one or more commands for controlling the drill bit according to the new control parameter of the selected candidate well path.

Example 2 is the system of example 1, wherein the operations further comprise: outputting the one or more commands for controlling the drill bit according to the control parameter of the drilling path using the pure-pursuit protocol; detecting that the location of the drill bit is off course from the drilling path; and in response to detecting that the location of the drill bit is off course from the drilling path, generating the plurality of candidate well paths using the pure-pursuit protocol, each candidate well path of the plurality of candidate well paths being configured to control the drill bit to the target location.

Example 3 is the system of example(s) 1-2, wherein the operations further comprise: receiving the start location of the drill bit before drilling has occurred in the subterranean formation; receiving a waypoint; receiving the target location; receiving an earth model indicating the presence or absence of obstacles within the subterranean formation; executing a path-planning protocol using the start location, the waypoint, the target location, and the earth model; and generating the reference well path based on a result of executing the path-planning protocol.

Example 4 is the system of example(s) 1-3, wherein the operations further comprise: displaying a visual representation of the subterranean formation; displaying a first visual indicator representing the location of the drill bit; displaying a second visual indicator representing the drilling path; updating a location of the first visual indicator to match the location of the drill bit while the drill bit is operating; and updating the second visual indicator from representing the drilling path to representing the selected candidate well path.

Example 5 is the system of example(s) 1-4, wherein the operations further comprise: calculating a plurality of objective functions for each candidate well path of the plurality of candidate well paths, the plurality of objective functions including the objective function; calculating a cost function for each candidate well path of the plurality of candidate well paths, wherein the cost function is a combination of two or more objective functions of the plurality of objective functions; and performing an optimization protocol on the plurality of objective functions, the performance of the optimization protocol resulting in the selection of the candidate well path from the plurality of candidate well paths, and the cost function associated with the selected candidate well path being a minimum from amongst the plurality of cost functions.

Example 6 is the system of example(s) 1-5, wherein the operation of performing the optimization protocol includes generating the new control parameter for controlling the drill bit according to the selected candidate well path.

Example 7 is the system of example(s) 1-6, wherein the operation of generating the drilling path includes executing the pure-pursuit protocol to generate the drilling path, wherein the execution of the pure-pursuit protocol generates the drilling path in a manner that satisfies a kinematic constraint or a velocity constraint of the drill bit.

Example 8 is a computer-implemented method comprising: generating, based on a presence or absence of obstacles within a subterranean formation, a reference well path for a drill bit adapted to drill in the subterranean formation, the reference well path including a start location and a target location; generating a drilling path for the drill bit using the reference well path and a physical constraint of the drill bit, the drilling path corresponding to a control parameter for controlling the drill bit, and the control parameter satisfying the physical constraint of the drill bit; tracking a location of the drill bit while the drill bit is drilling along the drilling path in the subterranean formation; generating, by executing a pure-pursuit protocol, a plurality of candidate well paths from the location of the drill bit to the target location; determining a result of an objective function for each candidate well path of the plurality of candidate well paths; selecting, based on the result of the objective function, a candidate well path from the plurality of candidate well paths, the selected candidate well path representing a target path from the location of the drill bit to the target location, and the selected candidate well path corresponding to a new control parameter for controlling the drill bit; and outputting one or more commands for controlling the drill bit according to the new control parameter of the selected candidate well path.

Example 9 is the computer-implemented method of example 8, further comprising: outputting the one or more commands for controlling the drill bit according to the control parameter of the drilling path using the pure-pursuit protocol; detecting that the location of the drill bit is off course from the drilling path; and in response to detecting that the location of the drill bit is off course from the drilling path, generating the plurality of candidate well paths using the pure-pursuit protocol, each candidate well path of the plurality of candidate well paths being configured to control the drill bit to the target location.

Example 10 is the computer-implemented method of example(s) 8-9, further comprising: receiving the start location of the drill bit before drilling has occurred in the subterranean formation; receiving a waypoint; receiving the target location; receiving an earth model indicating the presence or absence of obstacles within the subterranean formation; executing a path-planning protocol using the start location, the waypoint, the target location, and the earth model; and generating the reference well path based on a result of executing the path-planning protocol.

Example 11 is the computer-implemented method of example(s) 8-10, further comprising: displaying a visual representation of the subterranean formation; displaying a first visual indicator representing the location of the drill bit; displaying a second visual indicator representing the drilling path; updating a location of the first visual indicator to match the location of the drill bit while the drill bit is operating; and updating the second visual indicator from representing the drilling path to representing the selected candidate well path.

Example 12 is the computer-implemented method of example(s) 8-11, further comprising: calculating a plurality of objective functions for each candidate well path of the plurality of candidate well paths, the plurality of objective functions including the objective function; calculating a cost function for each candidate well path of the plurality of candidate well paths, wherein the cost function is a combination of two or more objective functions of the plurality of objective functions; and performing an optimization protocol on the plurality of objective functions, the performance of the optimization protocol resulting in the selection of the candidate well path from the plurality of candidate well paths, and the cost function associated with the selected candidate well path being a minimum from amongst the plurality of cost functions.

Example 13 is the computer-implemented method of example(s) 8-12, wherein performing the optimization protocol further comprises: generating the new control parameter for controlling the drill bit according to the selected candidate well path.

Example 14 is the computer-implemented method of example(s) 8-13, wherein generating the drilling path further comprises: executing the pure-pursuit protocol to generate the drilling path, wherein the execution of the pure-pursuit protocol generates the drilling path in a manner that satisfies a kinematic constraint or a velocity constraint of the drill bit.

Example 15 is a computer-program product tangibly embodied in a non-transitory machine-readable storage medium, including instructions configured to cause a processing apparatus to perform operations including: generating, based on a presence or absence of obstacles within a subterranean formation, a reference well path for a drill bit adapted to drill in the subterranean formation, the reference well path including a start location and a target location; generating a drilling path for the drill bit using the reference well path and a physical constraint of the drill bit, the drilling path corresponding to a control parameter for controlling the drill bit, and the control parameter satisfying the physical constraint of the drill bit; tracking a location of the drill bit while the drill bit is drilling along the drilling path in the subterranean formation; generating, by executing a pure-pursuit protocol, a plurality of candidate well paths from the location of the drill bit to the target location; determining a result of an objective function for each candidate well path of the plurality of candidate well paths; selecting, based on the result of the objective function, a candidate well path from the plurality of candidate well paths, the selected candidate well path representing a target path from the location of the drill bit to the target location, and the selected candidate well path corresponding to a new control parameter for controlling the drill bit; and outputting one or more commands for controlling the drill bit according to the new control parameter of the selected candidate well path.

Example 16 is the non-transitory machine-readable storage medium of example(s) 15, wherein the operations further comprise: outputting the one or more commands for controlling the drill bit according to the control parameter of the drilling path using the pure-pursuit protocol; detecting that the location of the drill bit is off course from the drilling path; and in response to detecting that the location of the drill bit is off course from the drilling path, generating the plurality of candidate well paths using the pure-pursuit protocol, each candidate well path of the plurality of candidate well paths being configured to control the drill bit to the target location.

Example 17 is the non-transitory machine-readable storage medium of example(s) 15-16, wherein the operations further comprise: receiving the start location of the drill bit before drilling has occurred in the subterranean formation; receiving a waypoint; receiving the target location; receiving an earth model indicating the presence or absence of obstacles within the subterranean formation; executing a path-planning protocol using the start location, the waypoint, the target location, and the earth model; and generating the reference well path based on a result of executing the path-planning protocol.

Example 18 is the non-transitory machine-readable storage medium of example(s) 15-17, wherein the operations further comprise: displaying a visual representation of the subterranean formation; displaying a first visual indicator representing the location of the drill bit; displaying a second visual indicator representing the drilling path; updating a location of the first visual indicator to match the location of the drill bit while the drill bit is operating; and updating the second visual indicator from representing the drilling path to representing the selected candidate well path.

Example 19 is the non-transitory machine-readable storage medium of example(s) 15-18, wherein the operations further comprise: calculating a plurality of objective functions for each candidate well path of the plurality of candidate well paths, the plurality of objective functions including the objective function; calculating a cost function for each candidate well path of the plurality of candidate well paths, wherein the cost function is a combination of two or more objective functions of the plurality of objective functions; and performing an optimization protocol on the plurality of objective functions, the performance of the optimization protocol resulting in the selection of the candidate well path from the plurality of candidate well paths, and the cost function associated with the selected candidate well path being a minimum from amongst the plurality of cost functions.

Example 20 is the non-transitory machine-readable storage medium of example(s) 15-19, wherein the operation of performing the optimization protocol includes generating the new control parameter for controlling the drill bit according to the selected candidate well path.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

The invention claimed is:

1. A system comprising:

a processing device; and a non-transitory medium comprising instructions that are executable by the processing device to cause the processing device to perform operations comprising:

generating, based on a presence or absence of obstacles within a subterranean formation, a reference well path for a drill bit adapted to drill in the subterranean formation, the reference well path including a start location and a target location, and the reference well path being generated based on a path-planning protocol that uses a waypoint provided as input to the path-planning protocol;

generating a drilling path for the drill bit using the reference well path and a physical constraint of the drill bit, the drilling path corresponding to a control parameter for controlling the drill bit, and the control parameter satisfying the physical constraint of the drill bit;

tracking a location of the drill bit while the drill bit is drilling along the drilling path in the subterranean formation;

generating, by executing a pure-pursuit protocol, a plurality of candidate well paths from the location of the drill bit to the target location;

determining a result of an objective function for each candidate well path of the plurality of candidate well paths;

selecting, based on the result of the objective function, a candidate well path from the plurality of candidate well paths, the selected candidate well path representing a target path from the location of the drill bit to the target location, and the selected candidate well path corresponding to a new control parameter for controlling the drill bit; and sending one or more commands to a drill string coupled to the drill bit once the selected candidate well path has been determined, the one or more commands instructing the drill bit to change drilling direction to move the drill string along the selected candidate well path, wherein the one or more commands comprise the new control parameter that includes a trajectory or an inclination of the drill bit.

2. The system of claim 1, wherein the operations further comprise:

outputting the one or more commands for controlling the drill bit according to the control parameter of the drilling path using the pure-pursuit protocol;

detecting that the location of the drill bit is off course from the drilling path; and in response to detecting that the location of the drill bit is off course from the drilling path, generating the plurality of candidate well paths using the pure-pursuit protocol, each candidate well path of the plurality of candidate well paths being configured to control the drill bit to the target location.

3. The system of claim 1, wherein the operations further comprise:

receiving the start location of the drill bit before drilling has occurred in the subterranean formation;

receiving the waypoint prior to executing the path-planning protocol;

receiving the target location;

receiving an earth model indicating the presence or absence of obstacles within the subterranean formation;

executing the path-planning protocol using the start location, the waypoint, the target location, and the earth model; and generating the reference well path based on a result of executing the path-planning protocol.

4. The system of claim 1, wherein the operations further comprise:

displaying a visual representation of the subterranean formation;

displaying a first visual indicator representing the location of the drill bit;

displaying a second visual indicator representing the drilling path;

updating a location of the first visual indicator to match the location of the drill bit while the drill bit is operating; and updating the second visual indicator from representing the drilling path to representing the selected candidate well path.

5. The system of claim 1, wherein the operations further comprise:

calculating a plurality of objective functions for each candidate well path of the plurality of candidate well paths, the plurality of objective functions including the objective function;

calculating a cost function for each candidate well path of the plurality of candidate well paths to generate a plurality of cost functions, wherein the cost function is a combination of two or more objective functions of the plurality of objective functions; and performing an optimization protocol on the plurality of objective functions, the performance of the optimization protocol resulting in the selection of the candidate well path from the plurality of candidate well paths, and the cost function associated with the selected candidate well path being a minimum from amongst the plurality of cost functions.

6. The system of claim 5, wherein the operation of performing the optimization protocol includes generating the new control parameter for controlling the drill bit according to the selected candidate well path.

7. The system of claim 1, wherein the operation of generating the drilling path includes executing the pure-pursuit protocol to generate the drilling path, wherein the execution of the pure-pursuit protocol generates the drilling path in a manner that satisfies a kinematic constraint or a velocity constraint of the drill bit.

8. A computer-implemented method comprising:

generating, based on a presence or absence of obstacles within a subterranean formation, a reference well path for a drill bit adapted to drill in the subterranean formation, the reference well path including a start location and a target location, and the reference well path being generated based on a path-planning protocol that uses a waypoint provided as input to the path-planning protocol;

generating a drilling path for the drill bit using the reference well path and a physical constraint of the drill bit, the drilling path corresponding to a control parameter for controlling the drill bit, and the control parameter satisfying the physical constraint of the drill bit;

tracking a location of the drill bit while the drill bit is drilling along the drilling path in the subterranean formation;

generating, by executing a pure-pursuit protocol, a plurality of candidate well paths from the location of the drill bit to the target location;

determining a result of an objective function for each candidate well path of the plurality of candidate well paths;

selecting, based on the result of the objective function, a candidate well path from the plurality of candidate well paths, the selected candidate well path representing a target path from the location of the drill bit to the target location, and the selected candidate well path corresponding to a new control parameter for controlling the drill bit; and sending one or more commands to a drill string coupled to the drill bit once the selected candidate well path has been determined, the one or more commands instructing the drill bit to change drilling direction to move the drill string along the selected candidate well path, wherein the one or more commands comprise the new control parameter that includes a trajectory or an inclination of the drill bit.

9. The computer-implemented method of claim 8, further comprising:

controlling the drill bit according to the control parameter of the drilling path using the pure-pursuit protocol;

detecting that the location of the drill bit is off course from the drilling path; and in response to detecting that the location of the drill bit is off course from the drilling path, generating the plurality of candidate well paths using the pure-pursuit protocol, each candidate well path of the plurality of candidate well paths being configured to control the drill bit to the target location.

10. The computer-implemented method of claim 8, further comprising:

receiving the start location of the drill bit before drilling has occurred in the subterranean formation;

receiving the waypoint prior to executing the path-planning protocol;

receiving the target location;

receiving an earth model indicating the presence or absence of obstacles within the subterranean formation;

executing the path-planning protocol using the start location, the waypoint, the target location, and the earth model; and generating the reference well path based on a result of executing the path-planning protocol.

11. The computer-implemented method of claim 8, further comprising:

displaying a visual representation of the subterranean formation;

displaying a first visual indicator representing the location of the drill bit;

displaying a second visual indicator representing the drilling path;

updating a location of the first visual indicator to match the location of the drill bit while the drill bit is operating; and updating the second visual indicator from representing the drilling path to representing the selected candidate well path.

12. The computer-implemented method of claim 8, further comprising:

calculating a plurality of objective functions for each candidate well path of the plurality of candidate well paths, the plurality of objective functions including the objective function;

calculating a cost function for each candidate well path of the plurality of candidate well paths to generate a plurality of cost functions, wherein the cost function is a combination of two or more objective functions of the plurality of objective functions; and performing an optimization protocol on the plurality of objective functions, the performance of the optimization protocol resulting in the selection of the candidate well path from the plurality of candidate well paths, and the cost function associated with the selected candidate well path being a minimum from amongst the plurality of cost functions.

13. The computer-implemented method of claim 12, wherein performing the optimization protocol further comprises:

generating the new control parameter for controlling the drill bit according to the selected candidate well path.

14. The computer-implemented method of claim 8, wherein generating the drilling path further comprises:

executing the pure-pursuit protocol to generate the drilling path, wherein the execution of the pure-pursuit protocol generates the drilling path in a manner that satisfies a kinematic constraint or a velocity constraint of the drill bit.

15. A computer-program product tangibly embodied in a non-transitory machine-readable storage medium, including instructions configured to cause a processing apparatus to perform operations including:

generating, based on a presence or absence of obstacles within a subterranean formation, a reference well path for a drill bit adapted to drill in the subterranean formation, the reference well path including a start location and a target location and the reference well path being generated based on a path-planning protocol that uses a waypoint provided as input to the path-planning protocol;

generating a drilling path for the drill bit using the reference well path and a physical constraint of the drill bit, the drilling path corresponding to a control parameter for controlling the drill bit, and the control parameter satisfying the physical constraint of the drill bit;

tracking a location of the drill bit while the drill bit is drilling along the drilling path in the subterranean formation;

generating, by executing a pure-pursuit protocol, a plurality of candidate well paths from the location of the drill bit to the target location;

determining a result of an objective function for each candidate well path of the plurality of candidate well paths;

selecting, based on the result of the objective function, a candidate well path from the plurality of candidate well paths, the selected candidate well path representing a target path from the location of the drill bit to the target location, and the selected candidate well path corresponding to a new control parameter for controlling the drill bit; and sending one or more commands to a drill string coupled to the drill bit once the selected candidate well path has been determined, the one or more commands instructing the drill bit to change drilling direction to move the drill string along the selected candidate well path, wherein the one or more commands comprise the new control parameter that includes a trajectory or an inclination of the drill bit.

16. The computer-program product of claim 15, wherein the operations further comprise:

outputting the one or more commands for controlling the drill bit according to the control parameter of the drilling path using the pure-pursuit protocol;

detecting that the location of the drill bit is off course from the drilling path; and in response to detecting that the location of the drill bit is off course from the drilling path, generating the plurality of candidate well paths using the pure-pursuit protocol, each candidate well path of the plurality of candidate well paths being configured to control the drill bit to the target location.

17. The computer-program product of claim 15, wherein the operations further comprise:

receiving the start location of the drill bit before drilling has occurred in the subterranean formation;

receiving the waypoint as an input prior to executing the path-planning protocol;

receiving the target location;

receiving an earth model indicating the presence or absence of obstacles within the subterranean formation;

executing the path-planning protocol using the start location, the waypoint, the target location, and the earth model; and generating the reference well path based on a result of executing the path-planning protocol.

18. The computer-program product of claim 15, wherein the operations further comprise:

displaying a visual representation of the subterranean formation;

displaying a first visual indicator representing the location of the drill bit;

displaying a second visual indicator representing the drilling path;

updating a location of the first visual indicator to match the location of the drill bit while the drill bit is operating; and updating the second visual indicator from representing the drilling path to representing the selected candidate well path.

19. The computer-program product of claim 15, wherein the operations further comprise:

calculating a plurality of objective functions for each candidate well path of the plurality of candidate well paths, the plurality of objective functions including the objective function;

calculating a cost function for each candidate well path of the plurality of candidate well paths to generate a plurality of cost functions, wherein the cost function is a combination of two or more objective functions of the plurality of objective functions; and performing an optimization protocol on the plurality of objective functions, the performance of the optimization protocol resulting in the selection of the candidate well path from the plurality of candidate well paths, and the cost function associated with the selected candidate well path being a minimum from amongst the plurality of cost functions.

20. The computer-program product of claim 19, wherein the operation of performing the optimization protocol includes generating the new control parameter for controlling the drill bit according to the selected candidate well path.

* * * * *